US006062603A

United States Patent [19]

Rich et al.

[11] Patent Number: 6,062,603

[45] Date of Patent: May 16, 2000

[54] DIRECT RESPONSE MAILING HAVING RESPONSE CARD AND SET OF STAMPS

[75] Inventors: Benny R. Rich; Frank J. Tortorici, both of Oakwood; James T. Pittman, Lula, all of Ga.

[73] Assignee: Dittler Brothers Incorporated, Atlanta, Ga.

[21] Appl. No.: 09/038,599

[22] Filed: Mar. 11, 1998

[51] Int. Cl.[7] ..... G09F 3/00

[52] U.S. Cl. ..... 283/71; 283/51; 283/56; 283/61

[58] Field of Search ..... 283/51, 56, 61, 283/62, 71, 79, 80

[56] References Cited

U.S. PATENT DOCUMENTS

| | | | |
|---|---|---|---|
| 4,641,578 | 2/1987 | Versaci | 283/51 |
| 4,872,706 | 10/1989 | Brewen et al. | 283/71 |
| 4,895,747 | 1/1990 | Birkholz et al. | 283/71 |
| 5,308,120 | 5/1994 | Thompson | 283/51 |
| 5,344,190 | 9/1994 | Volz | 283/56 |
| 5,423,573 | 6/1995 | De Passille | 283/71 |
| 5,547,738 | 8/1996 | Mitchell et al. . | |
| 5,902,439 | 5/1999 | Pike et al. | 283/71 |

*Primary Examiner*—Daniel W. Howell
*Assistant Examiner*—Monica Smith Carter
*Attorney, Agent, or Firm*—Dean W. Russell; Geoff L. Sutcliffe; Kilpatrick Stockton LLP

[57] ABSTRACT

A direct response mailing includes a response card and a set of stamps. The response card has a pressure sensitive adhesive patterned and applied to certain fields of the response card and has removable members placed on top of the pressure sensitive adhesive. The sheet of stamps is perforated into the individual stamps and are entirely unsupported with no adhesive applied to them. To formulate a response, a resident removes a desired set of stamps from the sheet and also detaches the removable members from the response card. The resident then places each stamp into a preferred one of the fields on the response card. Although the stamps have no adhesive, the pressure sensitive adhesive on the response card secures the stamps to the card. The direct response mailing does not have a remoistenable gummed sheet of stamps and thus benefits from not requiring the resident to lick the stamps and also has the benefit of being less prone to water damage during delivery in the mail. The direct response mailing also reduces waste and cost in comparison to a set of stamps fully coated with a pressure sensitive adhesive.

13 Claims, 3 Drawing Sheets

DIRECT RESPONSE MAILING HAVING RESPONSE CARD AND SET OF STAMPS

FIELD OF THE INVENTION

This invention relates generally to a direct response mailing and, more particularly, to a direct response mailing having a response card and set of stamps that eliminate the use of remoistenable gummed adhesive on the stamps while reducing waste and expense.

BACKGROUND OF THE INVENTION

A common piece of mailing is a direct response mailing which includes a response card that needs to be completed by the resident and returned to the sender. The direct response mailing includes a plurality of stamps or similar such members which the resident adheres to the response card to complete his or her reply. The mailing, for instance, may be for a music club in which the resident selects a preferred set of titles and adheres the stamps for those titles on the response card. As another example, the mailing may be for a sweepstakes in which the resident adheres desired game pieces to the response card. These types of mailings that include a response card and stamps to be adhered to the reply card are common and are used for various purposes.

The response card and stamps are manufactured generally in two ways. The first way involves the use of a remoistenable gummed sheet which has been perforated to form the plurality of stamps. The resident selects a desired set of stamps and then separates this desired set of stamps from the sheet. The resident next moistens the stamps, typically by licking the stamps, and then places the stamps on designated areas on the response card.

The direct response mailing having the remoistenable gummed sheet and response card has several disadvantages. For one, this type of direct response mailing has a high level of customer dissatisfaction. The residents receiving the direct response mailings dislike having to lick the stamps in order to adhere them to the response card. The residents do not like the taste of the stamps and dislike the unsanitary practice of placing a foreign object into their mouths. The mail handlers receiving the response cards would also prefer an alternative way of adhering the stamps to the response card due to hygienic issues associated with licked stamps. A further disadvantage of this type of direct response mailing is that it is often damaged in the mail due to the penetration of moisture, such as from rain or snow, to the remoistenable gummed stamps. As a result of the gummed stamps being moistened in transit, this type of direct response mailing suffers from a significant loss of a return rate due simply to the use of gummed stamps.

A preferred direct response mailing does not use any remoistenable gummed stamps but instead has a set of stamps formed with a pressure sensitive adhesive. With this type of direct response mailing, the stamps are comprised of a liner sheet overlaid with a patterned die cut set of stamps coated with the pressure sensitive adhesive. The resident removes a desired set of stamps from the liner and adheres the stamps to a response card. This type of direct response mailing having pressure sensitive stamps is preferred since residents do not need to lick the stamps in order to adhere them to the response card and since moisture does not easily damage the mailings in transit.

The direct response mailing having the stamps with a pressure sensitive adhesive, however, is not without its shortcomings. The stamps coated with a pressure sensitive adhesive are both more difficult and more expensive to manufacture. The stamps require a liner stock which is fully coated with the pressure sensitive adhesive and also requires the top sheet of stamps. The use of the liner stock and the pressure sensitive adhesive substantially increases the cost of manufacturing the stamps in comparison to a set of remoistenable gummed stamps. This type of direct response mailing also has an increased amount of waste. In addition to the reply card and the set of stamps, the direct response mailing also includes an entire liner sheet.

SUMMARY OF THE INVENTION

The present invention solves the problems described above with a direct response mailing and method for fabricating a direct response mailing. The direct response mailing comprises a response card and a set of stamps. The response card includes a bottom ply and an adhesive applied over at least one field of the bottom ply. A removable member is then applied over the at least one field onto the adhesive. The set of stamps are formed unsupported without any adhesive coating. The response card is completed by selecting a desired stamp, removing the member from the bottom ply, and then securing the stamp to the adhesive on the bottom ply.

In a preferred embodiment, the set of stamps comprise a sheet of stamps that have been formed by perforating the sheet into the individuals stamps. The adhesive is a pressure sensitive adhesive that is applied over the entire top surface of the bottom ply and the removable member is made from a liner sheet that has been patterned die cut to form the removable member. The response card may include any number of fields and corresponding removable members for receiving a respective number of stamps.

The direct response mailing does not use a remoistenable adhesive to secure the stamps to the response card. Consequently, the direct response mailing is not easily damaged by moisture in delivery. The direct response mailing receives increased satisfaction from the residents and from mail handlers since the stamps do not have any remoistenable adhesive and therefore do not need to be licked. The direct response mailing according to the invention has a reduced cost and reduced amount of waste in comparison to conventional mailings in which the stamps have been coated with the pressure sensitive adhesive. With the invention, only the response card includes the pressure sensitive adhesive, which typically has a smaller area than that of the entire selection of stamps. The amount of adhesive used may be even further reduced by applying the pressure sensitive adhesive only over the fields of the bottom ply which are for receiving stamps. In addition to a smaller amount of adhesive, the direct response mailing also uses a smaller liner in comparison to the typical sheet of stamps, which also acts to reduce waste and expense.

Accordingly, it is an object of the present invention to provide a direct response mailing that eliminates the use of a remoistenable gummed adhesive stamp sheet.

It is another object of the present invention to provide a direct response mailing that reduces waste.

It is a further object of the present invention to provide a direct response mailing that reduces expense.

It is yet another object of the present invention to provide a direct response mailing that is more resistant to moisture during delivery.

BRIEF DESCRIPTION OF THE DRAWINGS

The accompanying drawings, which are incorporated in and form a part of the specification, illustrate preferred embodiments of the present invention and, together with the description, serve to explain the principles of the invention. In the drawings.

DETAILED DESCRIPTION OF THE INVENTION

Figure 1:
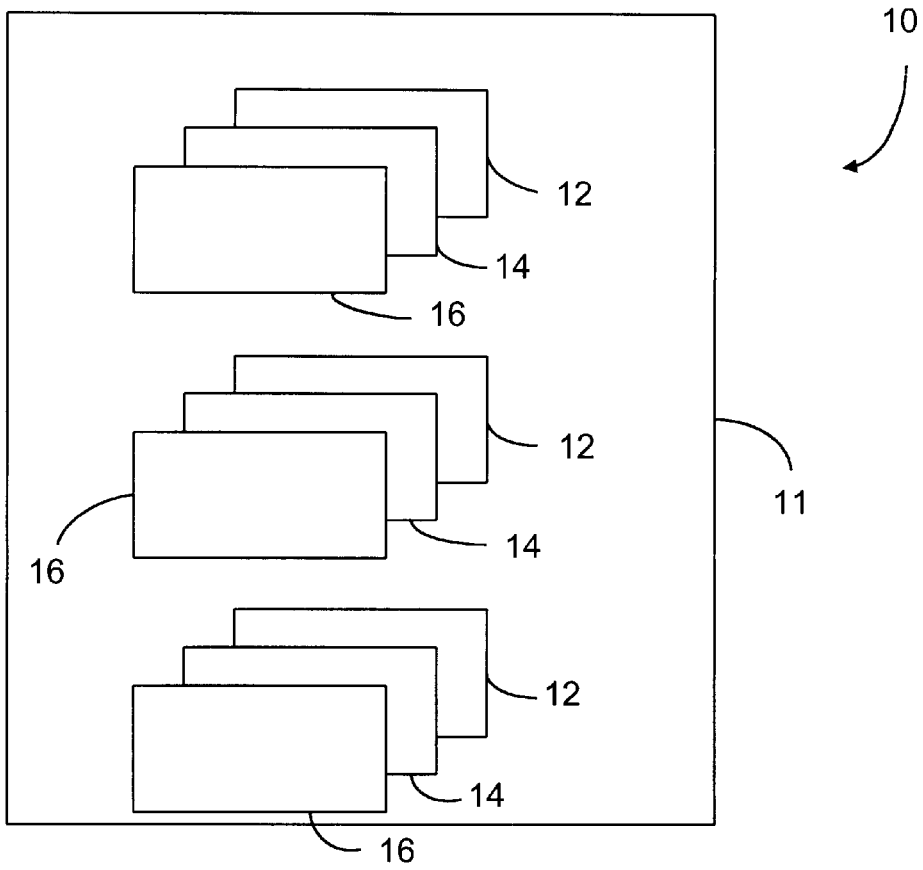
FIG. 1 is an exploded partial view of a response card according to a preferred embodiment of the invention.
Figure 2:
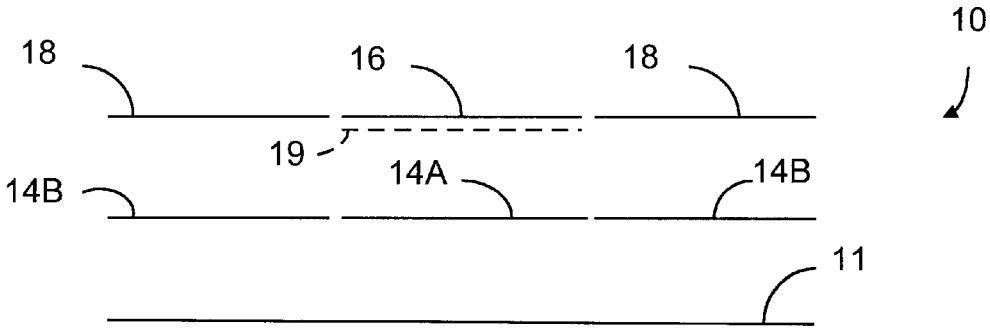
FIG. 2 is a cross-sectional view of the response card in FIG. 1.

Reference will now be made in detail to preferred embodiments of the invention, non-limiting examples of which are illustrated in the accompanying drawings. With reference to FIGS. 1 and 2, a response card 10 according to a preferred embodiment of the invention includes a bottom ply stock 11, an adhesive 14, and removable members 16. The adhesive 14 is applied over the fields 12 of the bottom ply stock 11 and corresponding removable members 16 are placed on top of the pressure sensitive adhesive 14 over the fields 12.

The adhesive 14 is preferably a pressure sensitive adhesive, such as a water borne pressure sensitive adhesive. The adhesive 14 may be applied only over the fields 12 of the bottom ply 11 and the removable members 16 may only be positioned over the fields 12 and the adhesive 14. In this manner, the removable members 16 are detachably secured to the bottom ply 11 and can be removed before securing a desired stamp 22, which is discussed below with reference to FIG. 3, to the bottom ply 11. Preferably, the removable members 16 form part of a liner 18 that is applied over the entire bottom ply 11 and the adhesive 14 is applied over the entire bottom ply 11 in order to secure the liner 18 to the bottom ply 11.

The adhesive 14 may actually comprise two different adhesives with a first adhesive 14A being applied over the fields 12 of the bottom ply 11 to detachably hold the members 16 to the bottom ply 11 and the other adhesive 14B being applied in regions outside of the fields 12 to secure the liner 18 firmly to the bottom ply 11. Alternatively, rather than using two different adhesives 14A and 14B, a more permanent adhesive 14 may be applied over the entire surface of the bottom ply 11 and a release coating 19 may be applied on the bottom surface of the removable members 16. In this manner, a single adhesive 14 can be used to detachably hold the members 16 to the bottom ply 11 and to secure the liner 18 firmly to the bottom ply 11.

The response card 10 may be fabricated from any suitable set of materials and by any suitable method. For instance, the bottom ply 11 and the liner 18 may both comprise a sixty pound stock and are secured together with the adhesive 14 which has been patterned at least over the fields 12. After the liner 18 has been placed on the bottom ply 11, the response card 10 is patterned die cut to form the removable members 16.

As will be apparent to those skilled in the art, the response card 10 may be manufactured in other ways. For instance, rather than applying the adhesive 14 to the bottom ply 11 , the adhesive 14 may be applied to liner 18 with this adhesive 14 being applied over the entire surface of the liner 18 or over just select portions corresponding to the fields 12 of the ply 11. The ply 11 is then secured on top of the liner 18 and the assembly is die-cut from the bottom to form the removable members 16.

Figure 4:
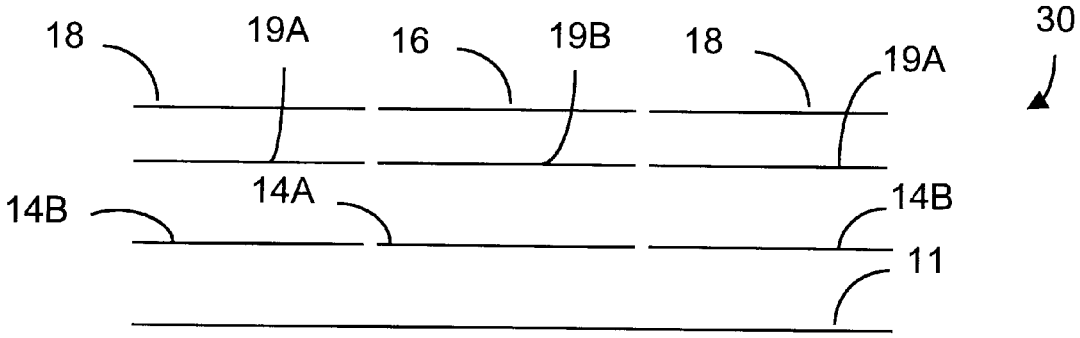
FIG. 4 is a second embodiment of a response card.

As a further example of an alternate manufacturing method, the response card may be manufactured according to a liner-less method. With reference to FIG. 4, a response card 30 according to a second embodiment of the invention is manufactured according to a liner-less method. A length of the first ply 11 is alternately coated with stripes of release coatings 14B and adhesive 14A. A length of the ply 18 is also alternately coated with stripes of release coatings 19B and adhesive 19A. The ply 18 is then applied to the first ply 11 in a staggered relationship so that the release coatings 14B of the first ply are aligned with the adhesive 19A on the ply 18 and the release coatings 19B on the ply 18 are aligned with the adhesive 14A on the first ply 11. The ply 18 is then die-cut to form the removable members 16. Although FIG. 4 depicts the entire inner side of the removable member 16 coated with the release coating 19B, the stripes of adhesives 14A and 19A and release coatings 14B and 19B may have a smaller width whereby the removable member may have a number of adhesive stripes 19A on its inner side. One suitable liner-less method is described in U.S. Pat. No. 5,547,738 to Mitchell et al., the disclosure of which is incorporated herein by this reference.

With response card 30, neither the ply 18 nor the first ply 11 forms a liner. Instead, both plies 11 and 18 have stripes of adhesive and release coatings which allow them to be secured to another substrate while being releasably secured to each other. For some applications, it may be desirable to secure removable members 16 to another substrate and to allow another item to be secured to the ply 11. Although the plies 11 and 18 have been shown as two separate plies, the plies 11 and 18 may have previously formed a single ply which has been cut to form the separate plies 11 and 18. With such a method, only one surface of the single ply needs to be coated with the alternating stripes of adhesive and release coatings. After the single ply has been separated into two separate plies 11 and 18, the coated surfaces of the two plies 11 and 18 are then releasably secured to each other in the above-described staggered manner.

Figure 3:
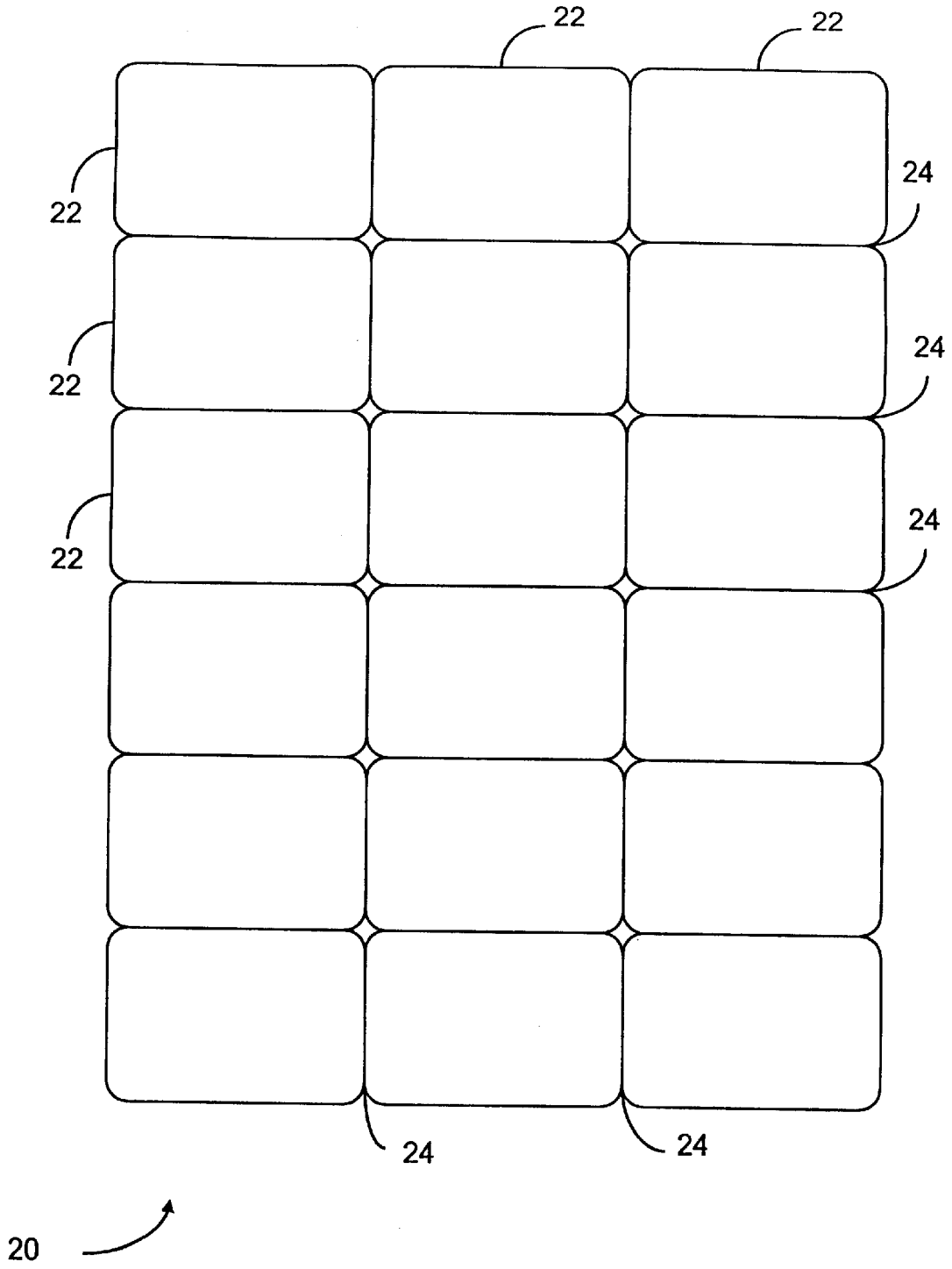
FIG. 3 is a top view of a set of stamps according to a preferred embodiment of the invention.

A sheet 20 of stamps according to a preferred embodiment of the invention is shown in FIG. 3. The sheet 20 includes a plurality of stamps 22 separated by perforations 24. Advantageously, the sheet 20 of stamps 22 includes no adhesive backing of any type. The stamps 22, however, need not comprise a sheet 20 of stamps 22 but may instead comprise a plurality of individual stamps 22 completely detached from each other. The stamps 22, for instance, may be comprised of sixty pound stock.

A direct response mailing according to the invention comprises the response card 10 and the stamps 22. The resident removes the preferred set of stamps 22 from the sheet 20 and adheres them to the response card 10. To adhere a stamp 22 to the reply card 10, the resident first removes one of the removable members 16. With a member 16 removed from the response card 10, the pressure sensitive adhesive 14 is exposed and the resident may place a desired stamp 22 on the adhesive 14, thereby securing the stamp 22 to the response card 10. After the resident has placed all of the desired set of stamps 22 onto the response card 10 into their desired fields 12, the resident returns the response card 10 in the mail.

The response card 10 may have any number of fields 12 for receiving the pressure sensitive adhesive 14 and the removable member 16 and the sheet 20 of stamps 22 may include any number of stamps 22. Thus, although the response card 10 has been shown with three fields 12, the response card 10 may include a lesser or greater number of fields 12. Furthermore, a direct response mailing according to the invention may comprise any number of response cards 10 and sheets 20 of stamps 22. For instance, a direct response mailing according to the invention may comprise a single response card 10 and multiple sheets 20 of stamps 22. Alternatively, a direct response mailing may include multiple response cards 10 with a single sheet 20 of stamps 22. A further possibility for a direct response mailing according to the invention is a mailing having a plurality of response cards 10 and a plurality of sheets 20 of stamps 22. Moreover, as discussed above, the stamps 22 may be detached from each other and provided individually and need not be interconnected to each other on a sheet 20.

The response card 10 and the sheet 20 of stamps 22 may include appropriate graphics. The response card 10, for instance, may have graphics on any of the removable members 16, on either or both a top surface or a bottom surface. The response card 10 may also include graphics on the bottom ply 11, such as within fields 12 which are revealed upon the removal of the members 16. The sheet 20 of stamps 22 also may include graphics, which may be placed on either or both surfaces of the sheet 20. The graphics on the response card 10 and on the stamps 22 will vary according to the particular use for the direct response mailing. The graphics on the removable member 16 and within the fields 12, for instance, may indicate or correspond with the graphics on a particular stamp 22 or set of stamps 22. The stamps 22 may have graphics which differ with each stamp 22 or may have graphics that are shared by one or more stamps 22. A direct response mailing for a music club, for instance, may have stamps 22 which represent unique CDs or tapes. A particular stamp 22, for instance, may have a CD listed for a particular artist and title on one side and a tape for the same artist and title listed on its opposite side. The graphics may be applied in any suitable manner, such as with ink jet printing or by lithoprinting. The types of graphics for the response card 10 and stamp 22 and the manner in which the graphics are applied will be apparent to those skilled in the art.

The adhesive 14 may comprise any suitable adhesive. The adhesive, for instance, may be a permanent adhesive, a removable adhesive, a repositionable adhesive, or even a remoistenable adhesive. The adhesive 14, as discussed above, may be associated with a release coating 19. Furthermore, the adhesive 14 may comprise any suitable grade, such as a water-borne adhesive, solvent-based adhesive, hot-melt adhesive, emulsion adhesive, UV curable adhesive, or electron-beam curable adhesive.

While the foregoing specification teaches the principles of the present invention, with examples provided for the purpose of illustration, it will be understood that the practice of the invention encompasses all of the usual variations, adaptations, or modifications, as come within the scope of the following claims and their equivalents.

We claim:

1. A direct response mailing, comprising:

(a) a response card, including:

(1) first ply having a field;

(2) an adhesive applied to the field of the first ply; and (3) a removable member detachably secured to the adhesive over the field of the first ply; and (b) a set of stamps which have no adhesive coating;

wherein the response card is completed by removing the removable member from the first ply covering the field and placing the desired stamp from the set of stamps onto the adhesive over the field.

2. The direct response mailing as set forth in claim 1, wherein the first ply has a plurality of fields with the adhesive being applied to each of the fields and the removable member comprises a plurality of removable members for being positioned over each of the fields.

3. The direct response mailing as set forth in claim 1, wherein the adhesive comprises a pressure sensitive adhesive.

4. The direct response mailing as set forth in claim 1, wherein the set of stamps comprises a plurality of stamps.

5. The direct response mailing as set forth in claim 1, wherein the set of stamps includes graphics on at least one of a top or bottom surface of each stamp.

6. The direct response mailing as set forth in claim 1, wherein the first ply includes graphics in each field.

7. The direct response mailing as set forth in claim 1, wherein the removable member includes graphics on at least one of a top or bottom surface of the member.

8. The direct response mailing as set forth in claim 1, wherein the set of stamps comprises a sheet of stamps separated by perforations.

9. The direct response mailing as set forth in claim 1, further comprising a liner applied to the first ply over the adhesive wherein the removable member comprises a portion of the liner.

10. The direct response mailing as set forth in claim 1, further comprising a release coating applied to a bottom surface of the removable member.

11. A direct response mailing, comprising:

a response card, including:

a first ply having a field;

an adhesive applied to the field of the first ply; and a removable member detachably secured to the adhesive over the field of the first ply; and a set of stamps which have no adhesive coating;

wherein the response card is completed by removing the removable member from the first ply and placing a desired stamp from the set of stamps onto the adhesive over the field, the response mailing further comprising a second adhesive on the first ply applied outside of the field.

12. The direct response mailing as set forth in claim 1, wherein the field includes first and second sections, the removable member includes third and fourth sections, the first section is aligned with the third section, the second section is aligned with the fourth section, the adhesive is applied on the first and fourth sections, and a release coating is applied to the second and third section.

13. A direct response mailing, comprising:

a response card, including;

a first ply having a field;

an adhesive applied to the field of the first ply; and a removable member detachably secured to the adhesive over the field of the first ply; and a set of stamps which have no adhesive coating;

wherein the response card is completed by removing the removable member from the first ply and placing a desired stamp from the set of stamps onto the adhesive over the field, the adhesive is applied in first sections on the first ply within each field, and the adhesive is applied to second sections of the removable member with the second sections being aligned with third sections of release coatings applied on the first ply within the field.

* * * * *